United States Patent [19]

Hauth et al.

[11] 4,222,015

[45] Sep. 9, 1980

[54] MICROWAVE CIRCULATOR ON A SUBSTRATE

[75] Inventors: Wolfgang Hauth; Wolfgang Ehrlinger, both of Backnang, Fed. Rep. of Germany

[73] Assignee: Licentia Patent-Verwaltungs-G.m.b.H., Frankfurt am Main, Fed. Rep. of Germany

[21] Appl. No.: 944,316

[22] Filed: Sep. 21, 1978

[30] Foreign Application Priority Data

Sep. 27, 1977 [DE] Fed. Rep. of Germany ..... 2743305

[51] Int. Cl.[2] ..... H01P 1/38

[52] U.S. Cl. ..... 333/1.1; 333/24.2

[58] Field of Search ..... 333/1.1, 24.1, 24.2

[56] References Cited

U.S. PATENT DOCUMENTS

| | | | |
|---|---|---|---|
| 3,733,563 | 5/1973 | Poirier | 333/1.1 |
| 3,854,106 | 12/1974 | Tresselt | 333/1.1 |

*Primary Examiner*—Paul L. Gensler

*Attorney, Agent, or Firm*—Spencer & Kaye

[57] ABSTRACT

A microwave circulator comprising a substrate having a resonator affixed to one side thereof and a ferrite element affixed to the other. The side of the substrate to which the ferrite element is secured is covered with metal on the surface surrounding the ferrite element and is electrically and mechanically coupled to a metallized coating on the periphery of the ferrite element. The surface of the ferrite element projecting from the substrate is also metallized.

4 Claims, 2 Drawing Figures

MICROWAVE CIRCULATOR ON A SUBSTRATE

BACKGROUND OF THE INVENTION

The present invention relates to a microwave circulator; that is, a nonreciprocal circuit element employing the gyrotropic effect to produce a phase shift which is a function of the direction of energy travel through the device. An etched resonator structure such as a wafer, containing a matching network and connecting leads is provided on one side of the circulator and a ferrite wafer is disposed on the other metallized side of the circulator in a recess made in the metallization, the latter side serving as the ground surface.

The most common circulator structure is the branching circulator. This is a nonreciprocal three-gate structure in which, in the ideal case, high-frequency energy is transported in only one sense of rotation and all gates are matched without reflection to the coupled waveguide system. The circulator may then be used to decouple signal input and output in active dipoles, as a directional line or as a switch.

For some time, such circulators have been produced in integrated form and applied to substrates using printed circuit techniques. The problem in the design of such circulators is the arrangement of the ferrite disc which is part of this component and which is penetrated by a magnetic field in a direction perpendicular to the surface of the substrate.

In the periodical IEEE Transactions on Magnetics, Vol. Mag.-11, No. 5, Sept. 1975, page 1275, FIG. 8, a circulator is shown in which the ferrite disc facing the side containing the conductor structure is inserted into the substrate and has its surface flush with the plane of the substrate. The metal layer disposed on the ground side is applied to the substrate and the ferrite disc in the same plane. This arrangement has the drawback that when there are temperature variations, the ferrite disc or the metal coating of the ground surface, respectively, may be destroyed, because the thermal expansion coefficients of ferrite (10 ppm/° C.) and of the substrate substance (6.6 ppm/° C.) are different.

Moreover, this embodiment requires adherence to very close tolerances during manufacture of the ferrite disc and its recesses and thus makes the process more expensive than other fabrication methods.

The arrangement illustrated in the 1971 Symposium IEEE-GMTT Int. Microwave Symposium Digest, Washington (1971) May, page 79, FIG. 1*a*, has the same drawbacks. In this embodiment, the ferrite disc is disposed in a recess in the substrate. Although this arrangement has electrical advantages, they do not compensate for the danger of destruction upon the occurrence of differences in temperature. This embodiment also requires that very close tolerances be met during the manufacture of the recess and the ferrite disc.

SUMMARY OF THE INVENTION

It is therefore an object of the present invention to provide a circulator which is easy to manufacture and has good electrical properties.

In accordance with the present invention, a dielectric substrate having first and second opposite surfaces is provided. The first surface has a metallized portion and a portion which is not metallized, the non-metallized portion having a first surface of a ferrite element which may be in the form of a disc, affixed thereto. The dimension of the non-metallized portion of the first surface of the substrate and the dimension of the first surface of the ferrite element are substantially the same.

The ferrite element also has a second surface opposite the first surface and a peripheral surface transverse to the first and second surfaces. The second and peripheral surfaces of the ferrite element are metallized, and an electrically conductive connection couples the metallized portion of the substrate to the metallized peripheral surface of the ferrite element.

A resonator, which may be in the form of a disc or a ring, is affixed opposite the ferrite element to the second surface of the substrate.

The substrate may be made of a dielectric material such as quartz glass, glass fiber reinforced polytetrafluoroethylene or aluminum oxide ceramics and the ferrite disc may be composed of Nitn ferrite or garnet. The electrically conductive connection between the metallized periphery of the ferrite element and the metallized portion of the first surface of the substrate may be a solder seam.

Such an embodiment has the advantage that it can be produced inexpensively and is not adversely affected by temperature changes.

The invention will be explained in detail with the aid of the following drawing figures which show one embodiment thereof.

DESCRIPTION OF THE PREFERRED EMBODIMENTS

Figure 1:
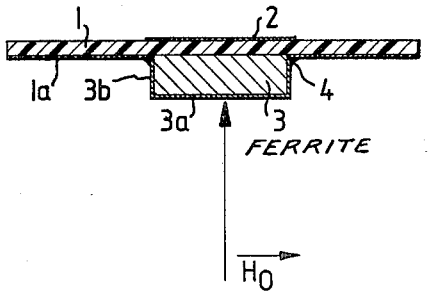
FIG. 1 is a sectional view of a circulator according to the invention.
Figure 2:
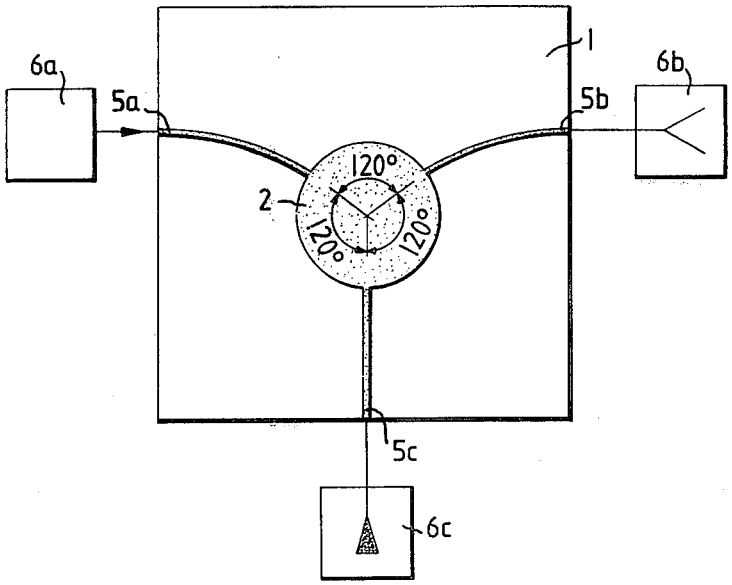
FIG. 2 is a top view of the same circulator.

Referring to FIG. 1, the substrate 1 of the circulators may be made of a dielectric material such as aluminum oxide ceramic. A circular resonator disc 2 having a metal coating, as shown in FIG. 2, is affixed to one surface of the substrate 1. A ferrite disc 3 is disposed on the other surface of substrate 1 exactly opposite the resonator structure 2. The ferrite disc is metallized on its surface 3*a* and on its peripheral surface 3*b*.

The substrate 1 is covered with a metal coating in the area surrounding the ferrite disc 3. A solder seam 4 surrounds the ferrite disc and secures the metal coating 3*b* on the peripheral surface of the ferrite disc to the metal coating 1*a* on the substrate.

The arrangement of the resonator structure 2 is shown in the top view of the circulator.

In the illustrated embodiment, three connecting leads 5*a*, 5*b* and 5*c* are arranged at an angle of 120° with respect to each other. Generally, matching networks such as conventional $\lambda/\frac{1}{4}$ transformers (not shown) are attached between the resonator disc and the connecting leads.

The described invention combines the advantages of a ceramic substrate with a simple method of manufacturing circulators in integrated form. The circulators may be fabricated by first metallizing the substrate 1, which may be composed of an aluminum oxide ceramic, on both sides. The resonator structure 2 and a matching network (not shown) as well as the connecting leads 5 are then produced by a conventional etching technique. This structure corresponds to the structure of known integrated circulators. The metallization 1*a* of the underside is next etched away below the resonator structure 2 and the ferrite disc 3 is placed thereon. The peripheral surface 3b and the surface 3a of the ferrite disc facing away from the resonator structure are provided with metallization.

The annular solder seam 4 establishes electrical contact between the annular surface 3a and the metal coating 1a, and also mechanically couples these elements. A magnetic system (not shown) of the type provided for known circulators produces a direct magnetic field $\vec{H}o$ perpendicular to the plane of the substrate.

The operation of this microwave circulator is shown in FIG. 2. A transmitter 6a coupled to connection 5a supplies an antenna 6b coupled to connection 5b. The energy, which is reflected from antenna 6b by reason of mismatching, is absorbed by the termination 6c coupled to connection 5c.

It will be understood that the above description of the present invention is susceptible to various modifications, changes and adaptations, and the same are intended to be comprehended within the meaning and range of equivalents of the appended claims.

What is claimed is:

1. A microwave circulator comprising a substrate composed of dielectric material having first and second opposite surfaces, the first surface of said substrate having a metallized portion and a portion which is not metallized, a resonator affixed to the second surface of said substrate opposite the portion of said first surface which is not metallized, said resonator having leads connected thereto, a ferrite element having first and second opposite surfaces and a peripheral surface transverse to said first and second opposite surfaces, the first surface of said ferrite element having substantially the same dimensions as the non-metallized portion of the first surface of said substrate and being affixed directly to said non-metallized portion opposite said resonator, the second and peripheral surfaces of said ferrite element being metallized, and an electrically conductive connection electrically and mechanically coupling the metallized portion of said substrate to the metallized peripheral surface of said ferrite element, said circulator being adapted for positioning within a magnetic field directed substantially perpendicular to said substrate.

2. A microwave circulator as defined in claim 1 wherein said ferrite element is in the shape of a disc.

3. A microwave circulator as defined in claim 1 wherein said dielectric material is selected from the group consisting of quartz glass, glass fiber reinforced polytetrafluoroethylene and aluminum oxide ceramics.

4. A microwave circulator as defined in claim 1 wherein said ferrite element is premagnetized by a magnetic field oriented perpendicular to a surface of said substrate.

* * * * *